United States Patent [19]

Markowski et al.

[11] 4,260,367

[45] Apr. 7, 1981

[54] FUEL NOZZLE FOR BURNER CONSTRUCTION

[75] Inventors: Stanley J. Markowski, East Hartford; Robert P. Lohmann, South Windsor, both of Conn.

[73] Assignee: United Technologies Corporation, Hartford, Conn.

[21] Appl. No.: 968,654

[22] Filed: Dec. 11, 1978

[51] Int. Cl.[3] ..... F23D 15/02

[52] U.S. Cl. ..... 431/353; 431/158; 431/284; 60/732; 60/742; 60/748

[58] Field of Search ..... 60/39.74 B, 39.65, 39.69; 431/351-353, 158

[56] References Cited

U.S. PATENT DOCUMENTS

| | | | |
|---|---|---|---|
| 3,161,228 | 12/1964 | Brodlin | 431/351 |
| 3,175,361 | 3/1965 | Schirmer et al. | 60/39.69 |
| 3,319,692 | 5/1967 | Reba et al. | 431/353 |
| 3,576,384 | 4/1971 | Peczeli et al. | 431/353 |
| 3,729,285 | 4/1973 | Schwedersky | 431/351 |
| 3,831,854 | 8/1974 | Sato et al. | 431/352 |
| 3,973,395 | 8/1976 | Markowski et al. | 431/352 |
| 4,054,028 | 10/1977 | Kawaguchi | 431/353 |
| 4,173,118 | 11/1979 | Kawaguchi | 431/352 |

*Primary Examiner*—Joseph Man-Fu Moy
*Attorney, Agent, or Firm*—Charles A. Warren

[57] ABSTRACT

In a two stage burner construction in which primary fuel burns in an annulus in a primary combustion zone and secondary fuel is discharged through the primary zone to a secondary zone downstream of the primary zone, vortex generators are used in the passage through which the fuel and air entering the primary zone to enhance the mixing and to improve the toroidal flow in the combustion zone. Other vortex generators are used to improve the mixing of the secondary fuel and air to improve secondary combustion. The vortex generators may be used in conjunction with a trip on the secondary nozzle tube to further enhance primary combustion.

13 Claims, 5 Drawing Figures

FUEL NOZZLE FOR BURNER CONSTRUCTION

BACKGROUND OF THE INVENTION

The copending application of Lohmann et al Ser. No. 968,652 has a fuel injection system which, by delineating the primary and secondary combustion zones and making possible the maintenance of optimum equivalence ratio in each zone over the entire combustion range, thereby effectively reduces undesirable emissions in the exhaust gas. Any improvements to the flow of fuel and air, the mixing of the air and fuel to further enhance engine performance will help to reduce the quantity of undesirable emissions beyond that accomplished in this injection system.

SUMMARY OF THE INVENTION

A feature of the present invention is an improvement of the air flow in the primary nozzle thereby further to enhance the fuel and air mixing and the desired discharge of the fuel into the primary chamber. Another feature is the introduction of additional mixing vortices in the fuel and air flow into the primary chamber by the use of vortex generators. Another feature is the use of a trip or baffle to cooperate with the vortex generators in controlling the location of the toroidal combustion zone in the primary chamber. Another feature is the use of additional vortex generators to improve the fuel and air flow into the secondary chamber. A primary feature is the further reduction of objectionable emissions from the burner by these refinements.

According to the invention, the swirling flow of primary zone air and fuel from the primary nozzle passages has imposed thereon a series of vortices that will result in more complete mixing of the fuel and air to promote combustion under conditions to minimize smoke and NOx emissions. The vortices are created by vortex generators in the air passage.

Combined with these vortex generators the secondary nozzle tube, axially displaced from the annular primary nozzle has a trip in the form of a disc thereon to guide the entering fuel and air from the primary nozzle into a radially outward direction to divert the flow in a recirculating path to help in concentrating the primary combustion near the inlet end of the chamber.

As an alternative to the trip or disc, the secondary fuel nozzle or tube may have vortex generators in a position to add vortices to the periphery of the recirculating path of the primary fuel also to help in concentrating the primary combustion near the inlet end of the burner.

Also combined with the vortex generators, the secondary fuel tube may have vortex generators internally near the discharge end, creating co-rotating or oppositely rotating vortices in the secondary fuel and air flow for improving the secondary combustion for which this tube supplies the fuel mixed with air.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
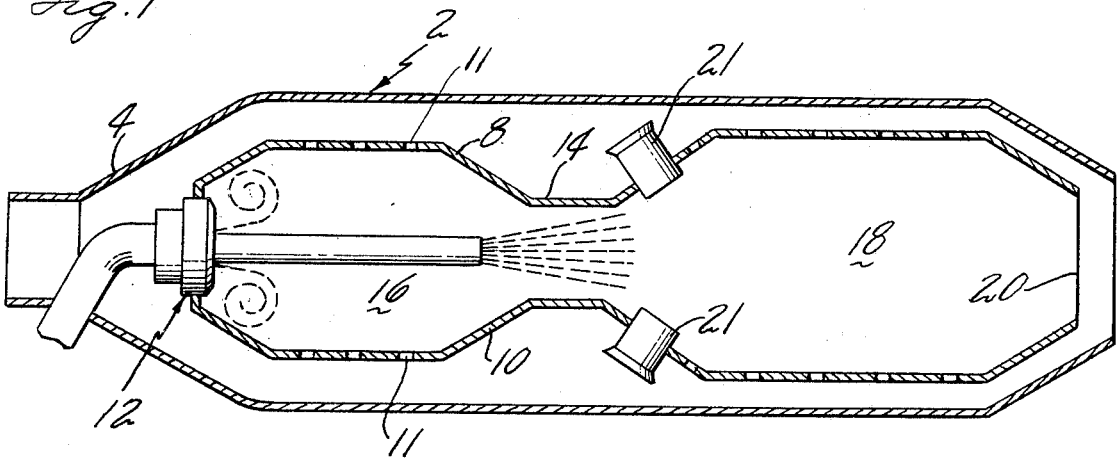
FIG. 1 is a sectional view through a burner construction.

The invention is shown in connection with a burner construction having a throat therein defining a primary combustion chamber upstream of the throat and a secondary combustion chamber downstream of the throat. As shown in FIG. 1, the burner device includes an annular duct 2 having a divergent inlet 4 forming a diffuser. Within this duct is the burner construction including an inlet end cap 6 and side walls 8 and 10 extending downstream from the edges of the cap. These walls have openings 11 therein for the entry of additional combustion air from the space around the burner. The cap supports a fuel nozzle structure 12 centrally therein. In the case of an annular construction, a multiplicity of nozzle structures are positioned around the circumference of the end cap which is annular.

The walls 8 and 10 are spaced from the duct for the flow of air therebetween and the walls 8 and 10, downstream of the cap converge to form a throat 14, thus defining between the cap and throat a primary combustion chamber 16. Downstream of the throat the walls 8 and 10 diverge again to define a secondary chamber 18 between the throat and the discharge end 20 of the burner. Swirlers 21 may be located in the burner walls just downstream of the throat.

Figure 2:
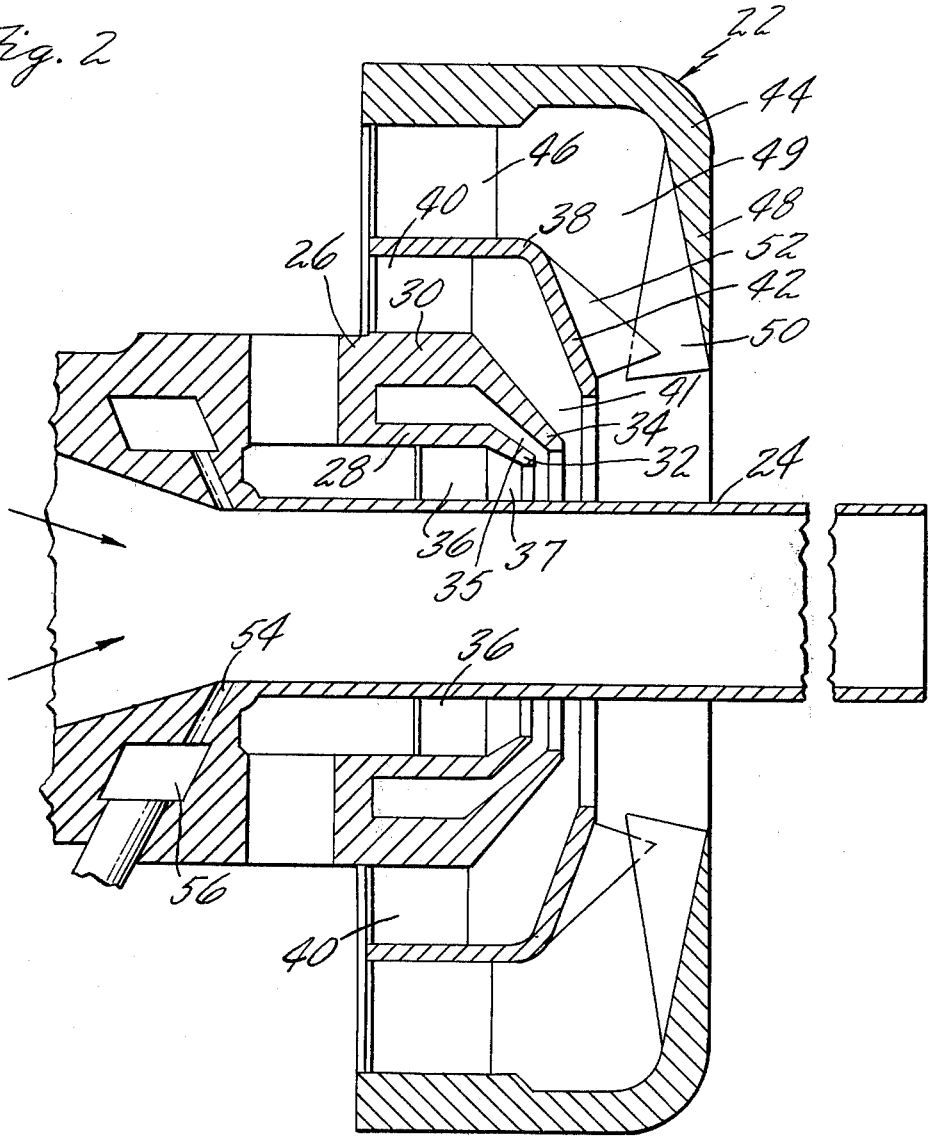
FIG. 2 is a sectional view through a nozzle embodying the invention.

The nozzle structure 12, FIG. 2, includes a primary annular nozzle 22 surrounding a secondary nozzle 24. The nozzle 22 includes a housing 26 having spaced concentric rings 28 and 30 thereon with inturned flanges 32 and 34 at the downstream end between which fuel is discharged from a fuel annulus 35. The inner inturned flange 32 is spaced from the secondary nozzle 24 by swirl vanes 36 to define an air passage 37 for air to mix with the fuel. Around the outer ring 30 is a third ring 38 spaced from ring 30 and having a row of swirl vanes 40 therebetween to impart a swirl to air passing between these rings in passage 41. An inturned flange 42 on the ring 38 guides this swirling air to mix with the fuel from between flanges 32 and 34 and the air from within flange 32.

In the arrangement shown is an additional ring 44 surrounding and spaced from ring 38 and having swirl vanes 46 therebetween. Ring 44 has an inturned flange 48 defining an annular passage 49 between this flange and flange 42 for the discharge of additional swirling air into the fuel and air mixture.

To enhance mixing between the air in passage 49 and the fuel air mixture formed by the flows from passages 35, 36 and 41, turbulence creating devices in the form of vortex generators 50 are mounted on the surface of flange 48 facing flange 42. These generators are preferably triangular-shaped vanes and are positioned to interact with the swirl from vanes 46 and to create trailing vortices extending downstream from the vanes without interfering with the existing swirl in the remainder of the passage. These vanes may be positioned all with the same angle to the swirl to produce co-rotational vortices, or the incidence angle of the vanes relative to the direction of the swirling flow may be alternating to create counter-rotating vortices.

It may be desirable to have similar vortex generators 52 on the facing flange 42 to create additional vortices in the swirling air. As shown, the tips of the generators 52 may overlap with the tips of the generators 50 or may be aligned with them. The desired result is to create staggered vortices in the stream of air between these flanges.

The secondary nozzle 24 is shown as a tube extending into the primary combustion chamber to a point downstream of the toroidal flow of fuel and air near the inlet cap where the primary combustion is taking place. This tube delivers air received as ram air from the diffuser at the upstream end of the duct and fuel is injected into the tube through holes 54 therein from an annular fuel supply chamber 56. The fuel and air is mixed as it discharges from the tube and passes through the throat into the secondary combustion chamber.

Figure 3:
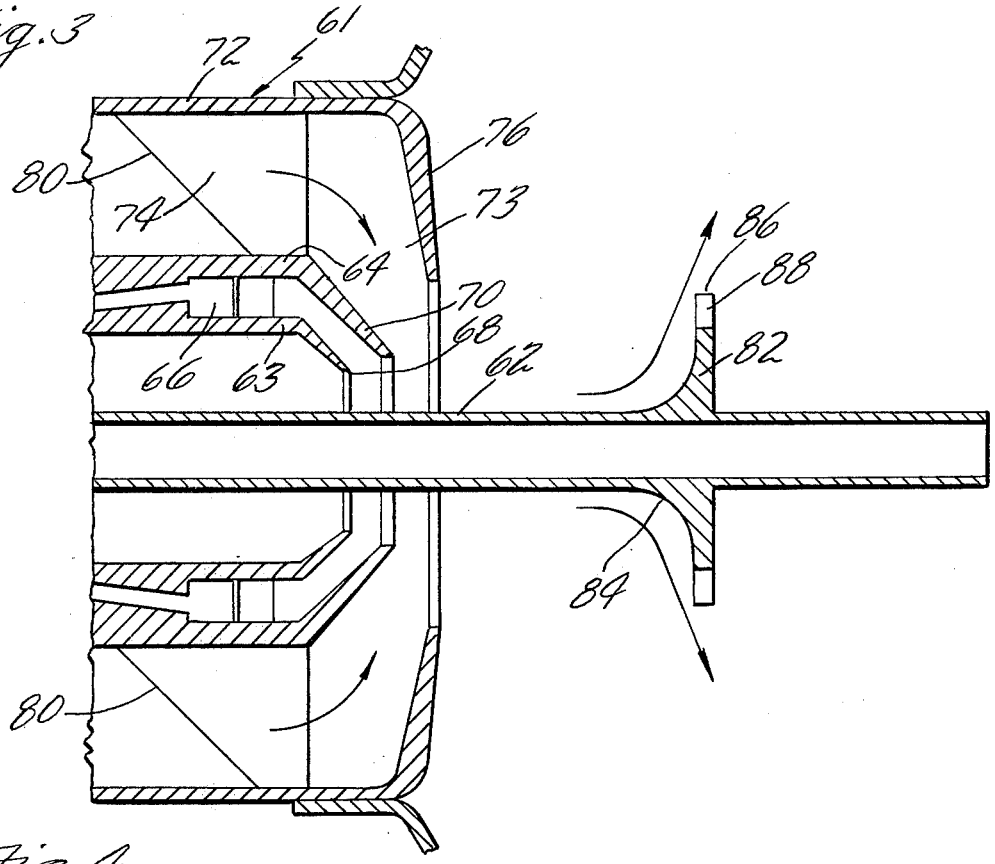
FIG. 3 is a sectional view of a modification.

The above construction has the vortex generators in the outer air path in the primary air passages. In FIG. 3, an alternative means of vortex generation is provided in the outer path but there is only one air path surrounding the annular fuel discharge path. As shown, the primary fuel nozzle 61 is annular and surrounds the secondary nozzle tube 62. The housing for the nozzle has two concentric rings 63 and 64 defining between them the fuel supply chamber 66 from which fuel discharges between inturned flanges 68 and 70 on the ends of these rings. Between the inner ring 63 and the tube 62 is an air flow passage for air to mix with the fuel. Around the outer ring 64 is a third ring 72 defining a second air path 73 with swirler vanes 74 across this path to impart a swirl to the air in this path. The ring 72 has an internal flange 76 spaced from flange 70 to direct this swirling air inward to mix with the fuel. The vanes 74 have swept back leading edges 80 that impart to the air passing over such vane a vortex that is superimposed on the swirl created by the vanes. The leading edge sweep of the vanes may be selected to produce either co-rotational vortices or counter-rotational vortices. In either event, the vortices improve the mixing of the air and fuel without affecting the net swirl that produces the desired toroidal flow of the fuel and air mixture in the combustion chamber.

To cooperate with this nozzle the tube 62 has a trip 82 in the form of a flange extending outwardly from the tube and having an arcuate upstream surface 84 to assist in turning the fuel and air flow outwardly to enhance the toroidal reverse flow in which the primary combustion takes place. This trip is located at a relatively short distance downstream of the inturned flanges as shown but at such a distance as to cause no interference with the desired flow such as an undesirable back pressure. This trip can have an irregular outer edge 86 so as to produce an irregular pattern to the flow passing over the edge. Square cut notches 88, as shown, will produce turbulence in an irregular annular path. A scalloped edge while less effective would still produce an irregular pattern to the flow.

Figure 4:
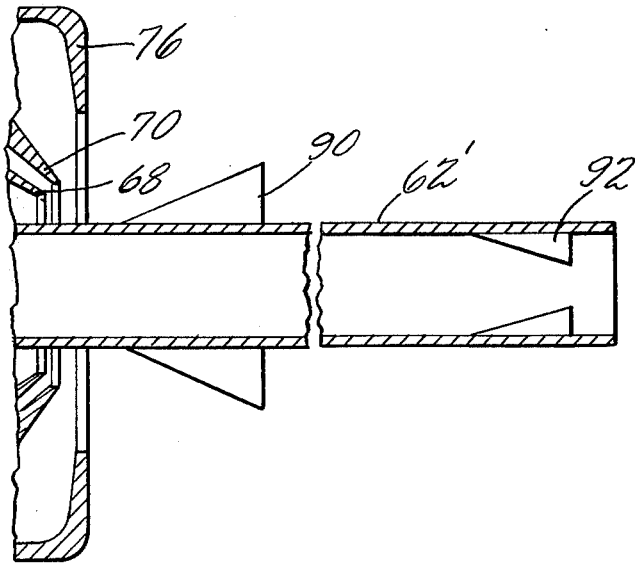
FIG. 4 is a sectional view of a modification of the secondary nozzle.

Instead of the trip or flange 82 of FIG. 3, the tube 62', FIG. 4, corresponding to the tube 62, may have vortex generators 90 thereon to generate either co-rotational or counter-rotational vortices in the flow of air and fuel into the toroidal configuration desired for primary combustion and further to enhance mixing of the fuel and air at the start of the primary combustion. Such vortex generators are desirably in the form of triangular vanes as shown and these are desirably positioned at such an angle so as not to significantly diminish the swirling of the fuel and air into the desired toroidal configuration.

In addition to such vortex generators it is also desirable, for further mixing of the secondary air and fuel, to position additional vortex generators 92 within the secondary tube 62' adjacent the discharge end. These generators, which are also desirably triangular vanes may lie in planes at angles to the axis of the tube to impart a local swirl to the secondary fuel and air mixture. The angularity of the vanes would desirably be such that the resulting flow from the end of the tube 62' would be contoured so as to fill the throat of the burner as the mixture enters this area. Thus the angularity of the vanes may be a function of the throat dimension and also the spacing of the end of the tube from the throat. In any event, these vanes impart the desired motion to the secondary fuel and air mixture and also create trailing vortices extending downstream from the tips of the vanes thereby to create a turbulence for more complete mixing of the fuel and air.

Figure 5:
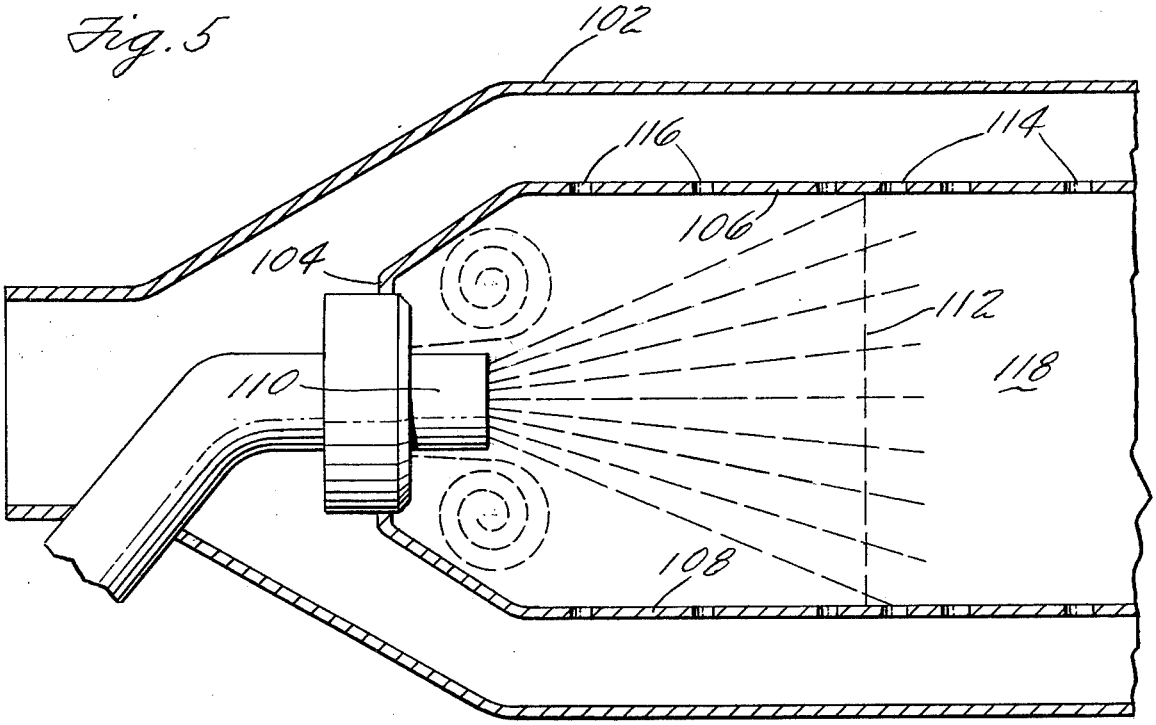
FIG. 5 is a sectional view, similar to FIG. 1 of a modified construction.

Although the invention has been described in connection with a burner having a throat between the primary and secondary zones, it is also applicable to a burner without a throat. As shown in FIG. 5, the combustion chamber duct 102, comparable to the duct 2 of FIG. 1, has a burner construction therein including an upstream end cap 104 and side walls 106 and 108 extending downstream therefrom in spaced relation to the duct. The arrangement shown is an annular burner in which the duct is annular and the walls are concentric sleeves within the duct annulus.

Fuel nozzles are positioned in the end cap, only one fuel nozzle 110 being shown. This nozzle is the same as above described, having a primary fuel annular nozzle surrounding a secondary fuel nozzle. The primary nozzle creates a torus of mixed fuel and air closely spaced from the end cap by directing the fuel and air mixture from the nozzle at a relatively steep angle to the axis of the burner. The primary combustion zone extends downstream to a point where substantially all the primary fuel is burned, this point being represented by the dotted line 112. This zone is structurally defined in the burner by the rows of secondary air admission holes 114 in the burner walls. The primary zone terminates just ahead of these holes and the secondary zone 118 begins at this point. The walls may have a row of smaller holes 116 near the cap for introduction of additional air into the primary zone.

The larger holes 114 provide an adequate supply of secondary air for complete combustion of the secondary fuel which is delivered from the secondary nozzle in a relatively narrow spray of fuel and air that extends axially of the burner and within the torus of primary combustion into the secondary combustion chamber. The angle of the secondary spray is adjusted so as nearly to fill the crosswise area of the burner at or near the first row of secondary air holes thereby to assure secondary combustion over nearly the entire area of the burner. As shown, there is no significant mixing of secondary fuel and air with the primary combustion products until primary combustion is substantially completed near the downstream end of the primary zone. Obviously, the breadth of the fuel and air discharge from the secondary nozzle is dependent upon the crosswise dimension of the burner and the distance from the secondary nozzle to the first row of secondary air holes.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A burner construction including:

an inlet end cap;

sidewalls extending downstream from the cap to define a primary combustion zone, said walls converging in a downstream direction at a point spaced from the cap to define a throat and diverging again downstream of the throat to define a secondary combustion zone;

an annular primary nozzle in the end cap for directing air and fuel at a large angle relative to the axis of the burner into the primary zone adjacent to the cap, said nozzle including an annular discharge fuel path and a surrounding ring having an inturned end flange and forming an annular air path;

a secondary nozzle within the annular nozzle for directing fuel and air at a small angle and substantially parallel to the burner axis, this small angle and the spacing of the throat from the cap being such that substantially all the fuel passes through the throat; and vortex generating vanes positioned on the flange on said ring to create vortices in the air in said air path.

2. A burner construction as in claim 1 in which the surrounding ring has swirler vanes extending across said air path upstream of the vortex generating vanes.

3. A burner construction as in claim 1 in which there are two surrounding rings with swirler vanes between them and with inturned flanges at their inner ends.

4. A burner construction as in claim 2 in which vortex generating vanes are positioned on the inturned flange.

5. A burner construction as in claim 1 in which the secondary nozzle has an annular flange thereon at a point spaced from the end of the primary nozzle.

6. A burner construction as in claim 5 in which the flange has a non-circular periphery.

7. A burner construction as in claim 1 in which the secondary nozzle projects beyond the primary nozzle and has vortex generating vanes on its surface at a point spaced from the primary nozzle.

8. A burner construction including:

an annular duct;

a burner within the duct including an end cap, sidewalls extending downstream from the end caps in spaced relation to each other to form a primary combustion zone close to said cap, said sidewalls converging in a downstream direction at a point spaced from the cap to form a throat, and diverging again to define a secondary zone;

an annular primary nozzle in the end cap and constructed to discharge fuel and air in an annulus at a steep angle to the burner axis, said nozzle including an annular fuel discharge path and a surrounding annular air path;

a secondary nozzle within the annular primary nozzle and extending beyond the primary nozzle, said secondary nozzle being constructed to deliver a mixture of fuel and air axially of the burner and at a small angle so as to enter the throat; and vortex generating vanes positioned in said annular path adjacent to the discharge end.

9. A burner construction as in claim 8 including an annular flange on the secondary nozzle at a point spaced from the primary nozzle.

10. A burner construction as in claim 8 including a row of vortex generators on said secondary nozzle at a point spaced from the end of the primary nozzle.

11. A burner construction as in claim 8 including a row of vortex generators within the secondary nozzle adjacent the discharge end.

12. A burner construction as in claim 8 in which the surrounding air path is formed by a ring surrounding the primary nozzle and with swirler vanes constructed to create trailing vortices in the swirling air from said vanes.

13. A burner construction including:

an annular duct;

a burner within the duct including an end cap, sidewalls extending downstream from the end caps in spaced relation to each other to form a primary combustion zone close to said cap, said sidewalls converging in a downstream direction at a point spaced from the cap to form a throat, and diverging again to define a secondary zone;

an annular primary nozzle in the end cap and constructed to discharge fuel and air in an annulus at a steep angle to the burner axis, said nozzle including an annular fuel discharge path and a surrounding annular air path;

a secondary nozzle within the annular primary nozzle and extending beyond the primary nozzle, said secondary nozzle being constructed to deliver a mixture of fuel and air axially of the burner and at a small angle so that substantially all the fuel enters the throat; and turbulence creating means positioned adjacent to the discharge end of the annular air path to create turbulence in the primary air discharging therefrom.

* * * * *